US006115940A

United States Patent [19]

Chen

[11] Patent Number: 6,115,940

[45] Date of Patent: Sep. 12, 2000

[54] SHOE HAVING WATERPROOF LINING SLEEVE AND WATER DRAINER

[76] Inventor: Eddie Chen, 4F, No. 255, Sec. 1, Taichung-Kang Rd., Hsi-Tun Dist., Taichung City, Taiwan

[21] Appl. No.: 09/441,432

[22] Filed: Nov. 16, 1999

[51] Int. Cl.[7] ..... A43B 9/02

[52] U.S. Cl. ..... 36/4; 36/14; 36/45; 36/55; 12/142 E

[58] Field of Search ..... 36/14, 45, 55, 36/4, 7.3, 17 R; 12/142 D, 142 E, 142 C, 146 C, 146 W

[56] References Cited

U.S. PATENT DOCUMENTS

| | | | |
|---|---|---|---|
| 528,473 | 10/1894 | Girard | 36/4 |
| 967,064 | 8/1910 | Savage | 36/4 |
| 1,204,365 | 11/1916 | Lee | 36/4 |
| 1,725,749 | 8/1929 | Blair | 36/4 |
| 2,306,306 | 12/1942 | Ferrettie | 36/4 |
| 2,574,582 | 11/1951 | Rollman | 36/14 |
| 3,863,366 | 2/1975 | Auberry et al. | 36/14 |
| 4,180,872 | 1/1980 | Chaikin | 36/4 |
| 4,508,582 | 4/1985 | Fink | 156/93 |
| 5,189,814 | 3/1993 | Barma | 36/4 |
| 5,433,021 | 7/1995 | Mahler | 33/449 |

*Primary Examiner*—Paul T. Sewell
*Assistant Examiner*—Troy Arnold
*Attorney, Agent, or Firm*—Fish & Richardson P.C.

[57] ABSTRACT

A shoe includes an upper shell, a lining sleeve lining the upper shell, a sole, and a lower shell disposed between the sole and the upper shell. The lower shell consists of at least one waterproof strap which is made of a waterproof material and which has a bottom margin connected to the sole, and a top margin to connect with the upper shell and the lining sleeve. The top margin is bifurcated to form an upwardly extending water draining part and an upwardly extending sealing part. The sealing part extends inwardly of the water draining part and has a height approximately equal to or greater than that of the water draining part. The water draining part extends inwardly of and is sewn to the bottom open ends of said upper shell and said lining sleeve, thus forming a stitch joint. The sealing part is sealingly bonded to the stitch joint.

12 Claims, 8 Drawing Sheets

SHOE HAVING WATERPROOF LINING SLEEVE AND WATER DRAINER

BACKGROUND OF THE INVENTION

1. Field of the Invention

The invention relates to a shoe or boot, more particularly to one having a waterproof lining sleeve and a water draining arrangement disposed at a stitched seam of the shoe of boot.

2. Description of the Related Art

It is known in the art to provide an arrangement or construction for waterproofing a shoe or boot by sealing a stitched seam against water and/or draining out water intruding through the stitched seam. U.S. Pat. No. 2,200,333 discloses a boot of hard usage, wherein a rubber boot portion sewn to a leather top has a bifurcated upper edge and a channel extending in and around the upper edge. The lower margin of the leather top is inserted into the channel and sealingly sewn to the upper edge so that the lower margin is sandwiched in the bifurcated upper edge of the rubber boot portion. The joint formed between the leather top and the rubber boot construction as such exhibits good watertight sealing characteristics, high strength and durability.

U.S. Pat. No. 5,249,375 suggests a boot for sailing or winter sports, which has a cuff extending exteriorly of an upper of the boot and a drain outlet located at the joint between the cuff and a foot portion behind the ankle.

German patent No. 607267 discloses a boot which includes a joint where an upper is stitched to a lower. The top margin of the lower is formed with a pad projecting outwardly from the outer surface of the lower, and a shoulder above the projecting pad. The bottom end of the upper extends above the shoulder and is stitched to the top margin of the lower above the shoulder. This arrangement not only can drain out water intruding through the stitch holes, but also protects the stitched part from being rubbed and hence wearing.

There is a socket-like lining of a waterproof but air-permeable fabric material available for making a waterproof shoe. An example of such a lining is disclosed in German Utility Patent No. G 9113139.1. Such a socket-like lining is disposed inside a shoe with the top end thereof sewn to the top end of the shoe.

The material of the above-mentioned socket-like lining is also used in making a waterproof lining in the form of a sleeve which has no sole portion. In making a shoe with such a lining, after the lining is placed in a shell of the shoe, the lining per se is first lasted so as to connect with an insole. The shell of the shoe is lasted subsequently for connection with an outsole.

Although provision of such a waterproof lining, either the socket-like lining or the lining sleeve, inside a shoe provides protection of a wearer's foot against water, water may intrude into the space between the shell and the lining sleeve in case of defects or degradation in waterproof sealing and would therefore make the wearer feel uncomfortable, especially in cold weather which can freeze the intruding water.

In order to cope with the problems associated with the use of such a waterproof lining, the applicant of this application suggested a water-draining boot in a copending U.S. patent application Ser. No. 09/209,597. The boot as disclosed has a lower, an upper, and a waterproof lining sleeve disposed inside and along the inner surface of the upper. The top open end of the lining sleeve is sewn to the top open end of the upper. The bottom open end of the lining sleeve is not connected to a sole, but is rather sewn to the top open end of the lower together with the bottom open end of the upper. In this boot, if water intrudes into the space between the upper and the lining sleeve, water can be drained out through the stitch joint of the lining sleeve, the upper, and the lower. The boot further has a sealing means attached to the stitch joint so as to prevent water from entering into the inside of the upper and the lower. The sealing means therein is prepared separately from the water draining parts, and is attached thereto by adhesive bonding.

SUMMARY OF THE INVENTION

An object of the present invention is to provide an integral water draining and sealing means which facilitates the fabrication of a shoe or boot of the type having a waterproof lining sleeve and capable of draining out water which may intrude into a space between an upper and the lining sleeve.

Accordingly, the present invention provides a shoe which comprises an upper shell having a top open end and a bottom open end, and a lining sleeve disposed inside and lining the upper shell. The lining sleeve has a top open end connected to the top open end of the upper shell, and a bottom open end extending along the bottom open end of the upper shell. The shoe further includes a sole, and a lower shell disposed between the sole and the upper shell. The lower shell consists of at least one waterproof strap which is made of a waterproof material and which has a bottom margin connected to the sole, and a top margin to connect with the upper shell and the lining sleeve. The top margin of the waterproof strap is bifurcated to form an upwardly extending water draining part and an upwardly extending sealing part. The sealing part extends inwardly of the water draining part and has a height approximately equal to or greater than that of the water draining part. The water draining part extends inwardly of and is sewn to the bottom open ends of the upper shell and the lining sleeve, thus forming a stitch joint. The sealing part is sealingly bonded to the stitch joint.

BRIEF DESCRIPTION OF THE DRAWINGS

Other features and advantages of the present invention will become apparent in the following detailed description of the preferred embodiment with reference to the accompanying drawings, of which:

FIG. 4*a* is a schematic view showing a lining sleeve disposed inside the shoe of FIG. 1;

FIG. 8A is a cross-sectional view of the portion of FIG. 8;

DETAILED DESCRIPTION OF THE PREFERRED EMBODIMENTS

Figure 1:
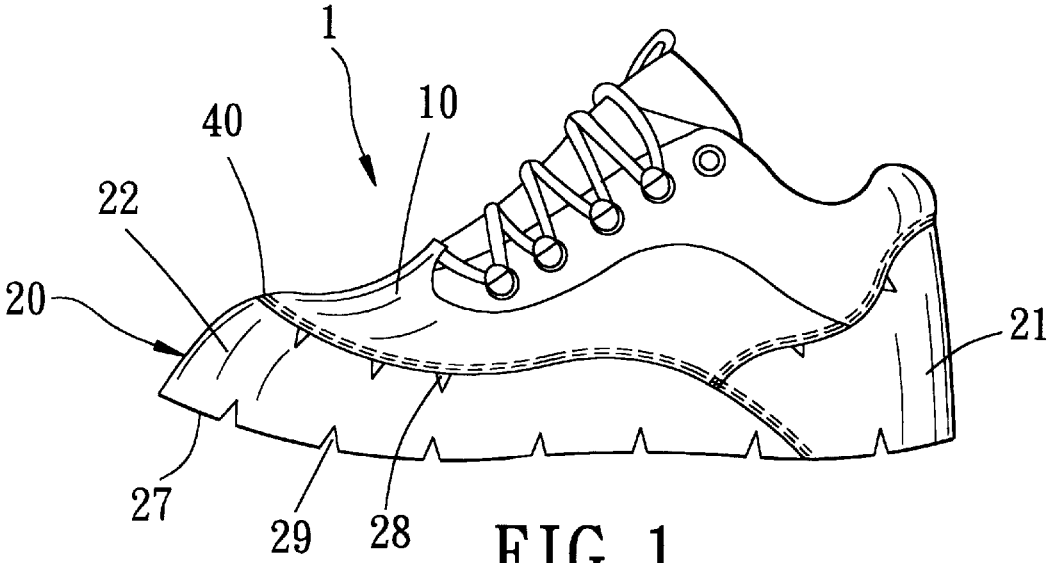
FIG. 1 is a front view of a first preferred embodiment of the present invention excluding a sole.

Referring to FIGS. 1–4, a shoe 1 embodying the present invention is shown to include an upper shell 10, a lower shell 20, and a sole 50. The lower shell 20 extends between and interconnects the upper shell 10 and the sole 50.

The upper shell 10 is provided with a lining sleeve 11 to line the inner surface of the upper shell 10. As shown in FIG. 4*a,* the lining sleeve 11 has a profile substantially conforming to that of the upper shell 10 and is made of a material which is waterproof but air-permeable. The top open end of the lining sleeve 11 is sewn to the top open end of the upper shell 10. The bottom open end of the lining sleeve 11 extends substantially along the bottom open end of the upper shell 10.

The lower shell 20 consists of two waterproof straps 21, 22. The strap 21 extends along the heel of the lower shell 20 and has two ends extending forward from the heel to a distance on two sides of the lower shell 20. The strap 22 extends along the toe of the lower shell 20 and has two end parts extending rearward on two sides of the lower shell 20 to be jointed with the straps 21 via sewing and sealing processes.

Figure 5:
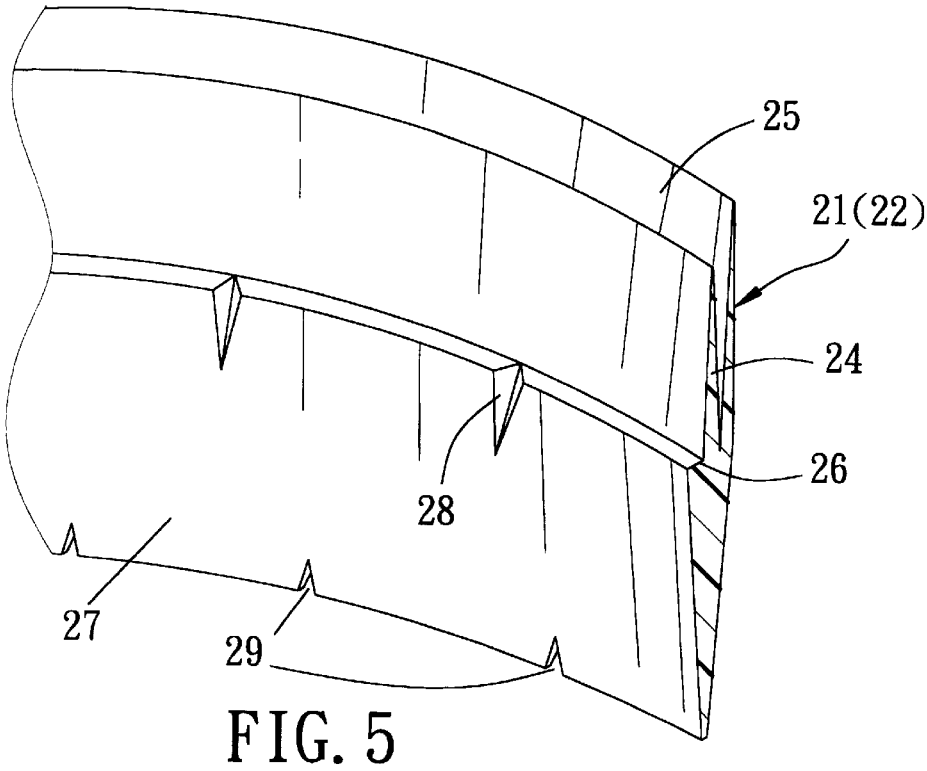
FIG. 5 is a fragmentary view showing the waterproof strap of the lower shell of the first embodiment.

Each strap 21, 22 is prepared from a waterproof sheet material obtained by casting a waterproof rubber or plastic material, or by trimming a waterproof leather or plastic sheet formed by press molding followed by splitting. As shown in FIG. 5, the top margin of each strap 21 or 22 is bifurcated to have a water draining part 24 and a sealing part 25, and in addition, is formed with a shoulder 26 which projects outwardly from the water draining part 24. The sealing part 25 extends inwardly of the water draining part 24 and has a height approximately equal to or greater than that of the water draining part 24. Preferably, the water draining part 24 has a height of about 10–20 mm, while the sealing part 25 has a height of about 15–25 mm. The strap 21 further has a bottom margin 27 for connection with the sole 50. A plurality of draining grooves 28 are formed in the edge of the shoulder 26. Notches 29 are formed in the bottom margin 27 of the strap 21.

Figure 6:
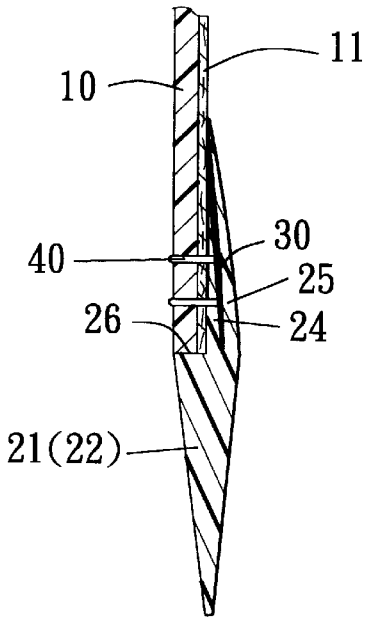
FIG. 6 is a sectional view taken along line 6—6 of FIG. 2.

Referring again to FIGS. 1–3, the bottom open ends of the upper shell 10 and the lining sleeve 11 are sewn to the top margins of the straps 21 and 22, thereby forming a stitched joint 40 between the upper and lower shells 10 and 20. As shown in FIG. 6, the stitch joint 40 is formed where the bottom open ends of the upper shell 10 and the lining sleeve 11 overlap with the top margins of the straps 21 and 22. In particular, the bottom open ends of the upper shell 10 and the lining sleeve 11 extend outwardly of the water draining part 24 of the top margin of each strap 21 or 22 and rest on the shoulder 26 thereof. The width of the shoulder 26 is substantially equal to the total thickness of the lining sleeve 11 and the upper shell 10 so that the top margin of the strap 21 or 22 is flush with the outer surface of the upper shell 10. The water draining part 24 is sewn to the bottom open ends of the upper shell 10 and the lining sleeve 11. The water draining grooves 28 in the edge of the shoulder 26 are aimed at increasing the rate of draining out water. To provide a watertight seal at the stitched joint 40, it is just necessary to place a waterproof adhesive material or a sealant 30 between the water draining part 24 and the sealing part 25 which is integral with the draining part 24 and then press the sealing part 25 against the sealant 30. The aforesaid water sealing process can be carried out by turning inside out the upper and lower shells 10 and 20 as they both are soft and flexible.

Figure 2:
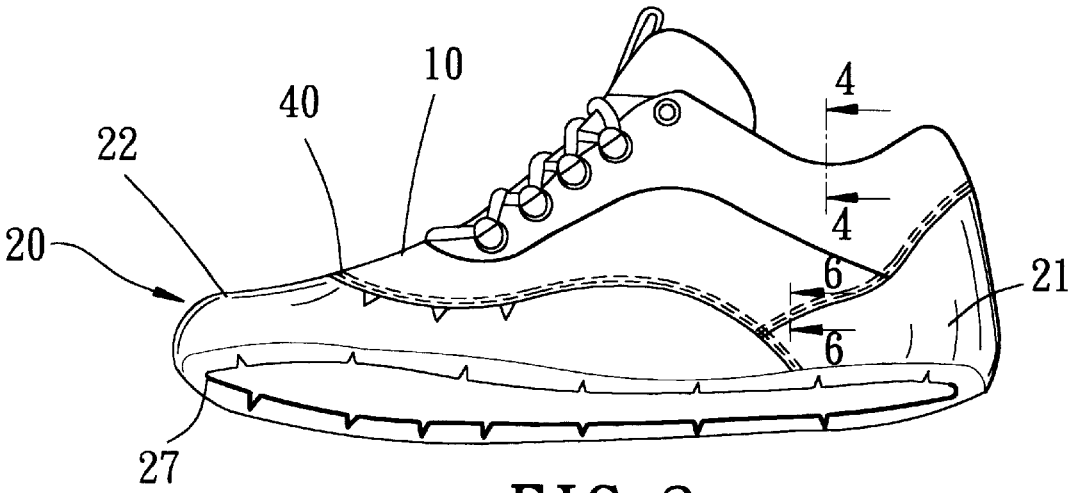
FIG. 2 is the same view as FIG. 1 but with a lower shell being lasted.
Figure 3:
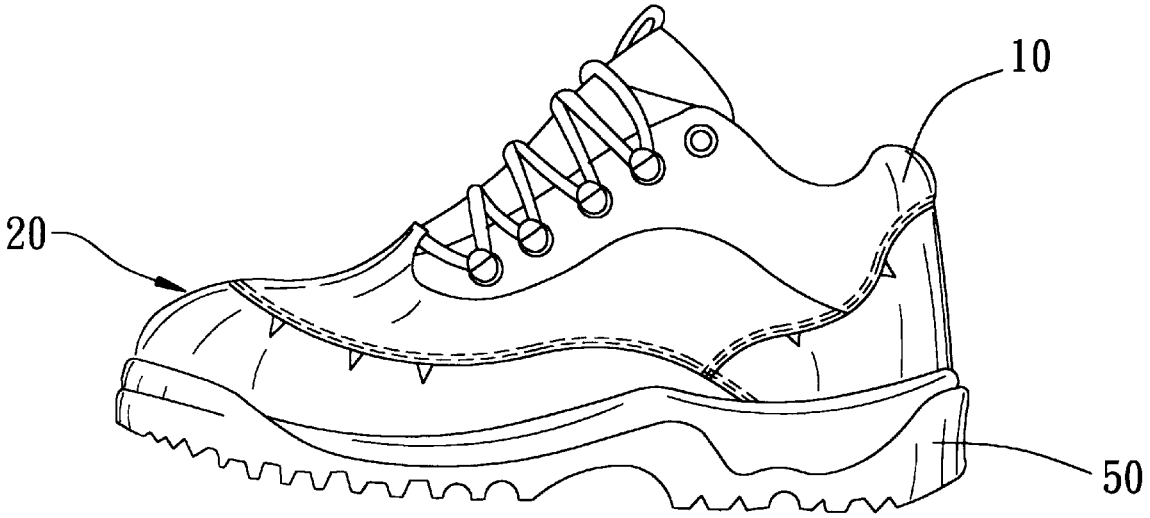
FIG. 3 is the same view as FIG. 1 but including the sole.
Figure 4:
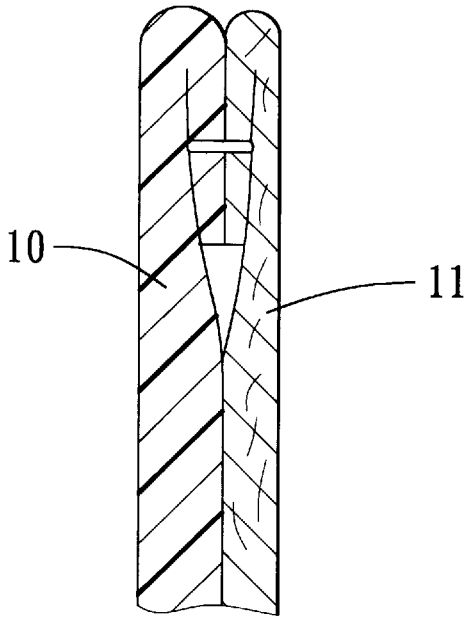
FIG. 4 is a sectional view taken along line 4—4 of FIG.
Figure 4:
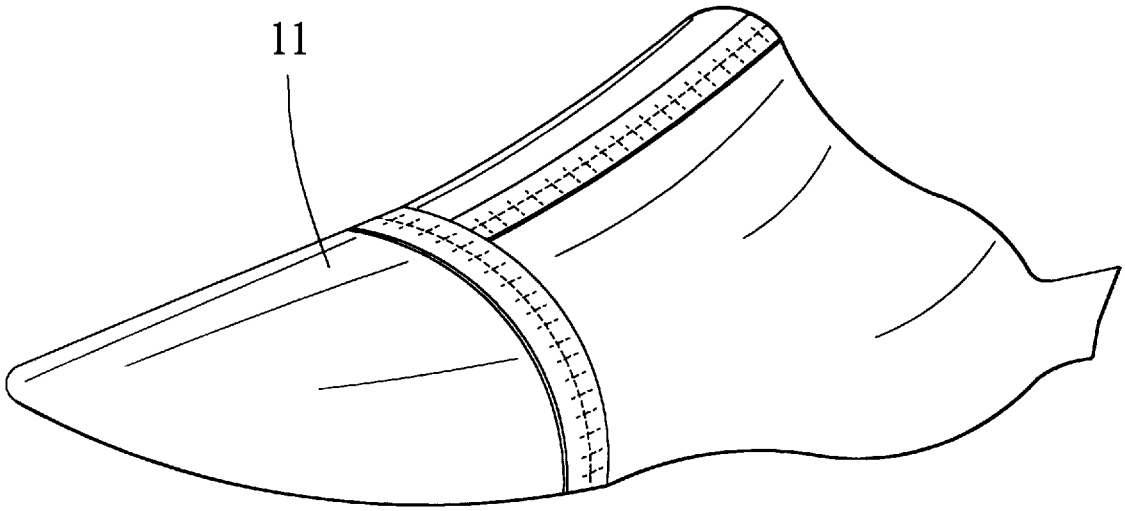

The bottom margins 27 of the straps 21 and 22 are lasted in a conventional manner to have a configuration as shown in FIG. 2, and then connected to the sole 50 in a conventional manner. The notches 29 provided in the bottom margin 27 serve to reduce wrinkles that will be produced upon bending and shaping of the bottom margin 27 of the straps 21 and 22 during the lasting process.

Figure 7:
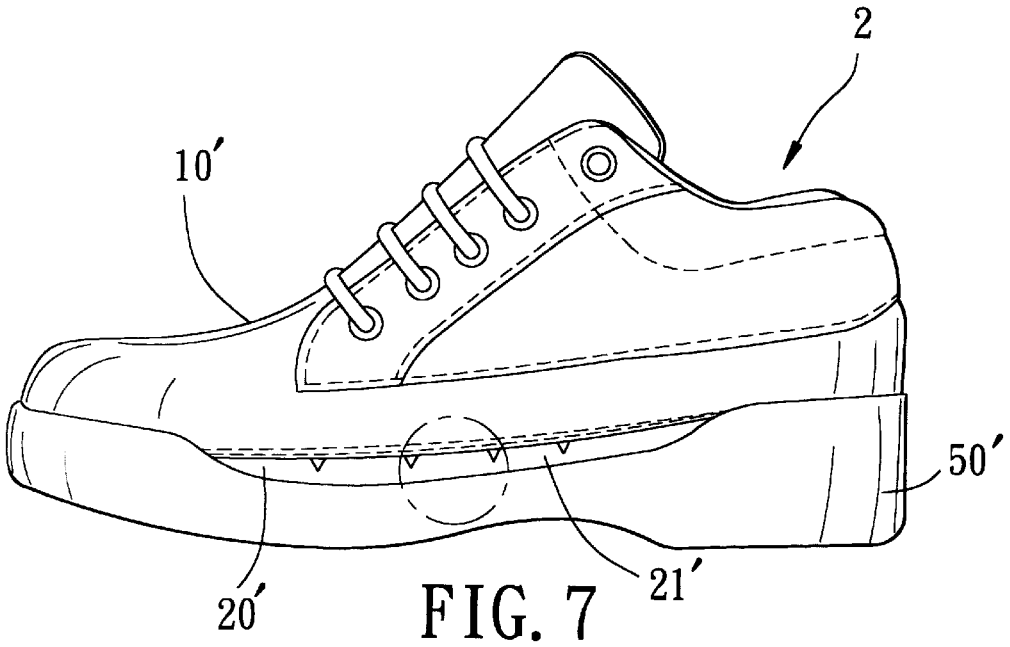
FIG. 7 is a front view of a second preferred embodiment according to the present invention.
Figure 8:
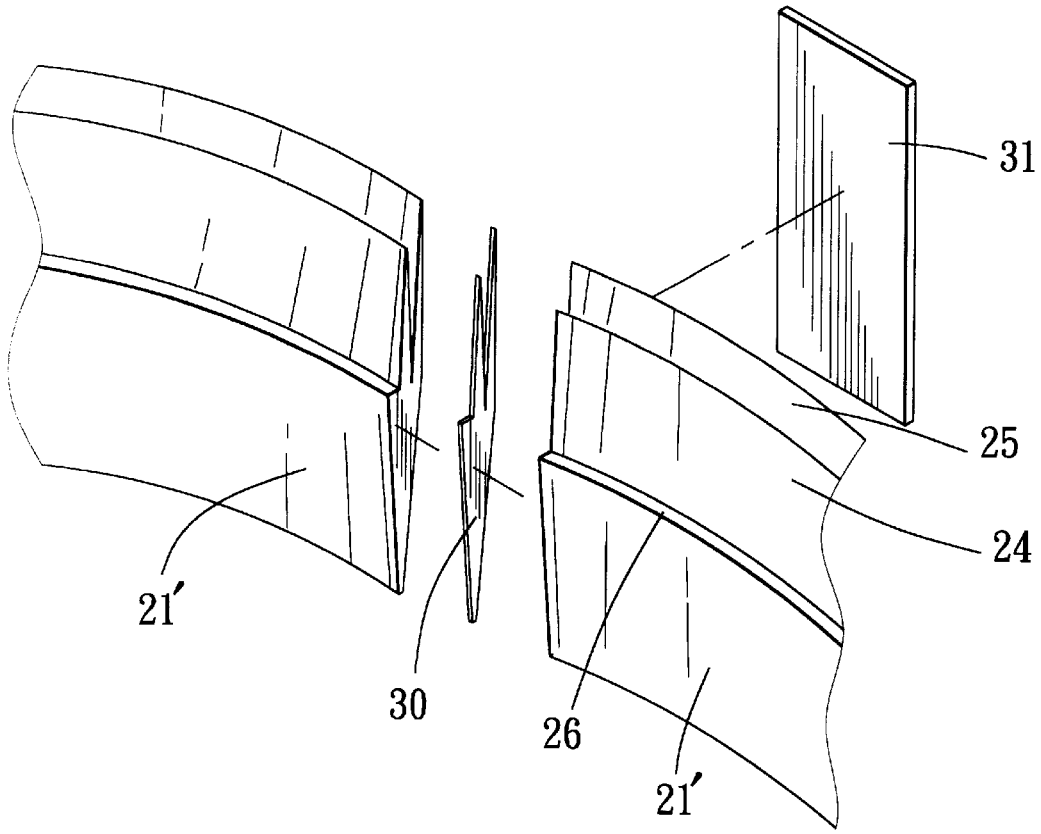
FIG. 8 is an enlarged view of a portion encircled in FIG. 7.
Figure 8:
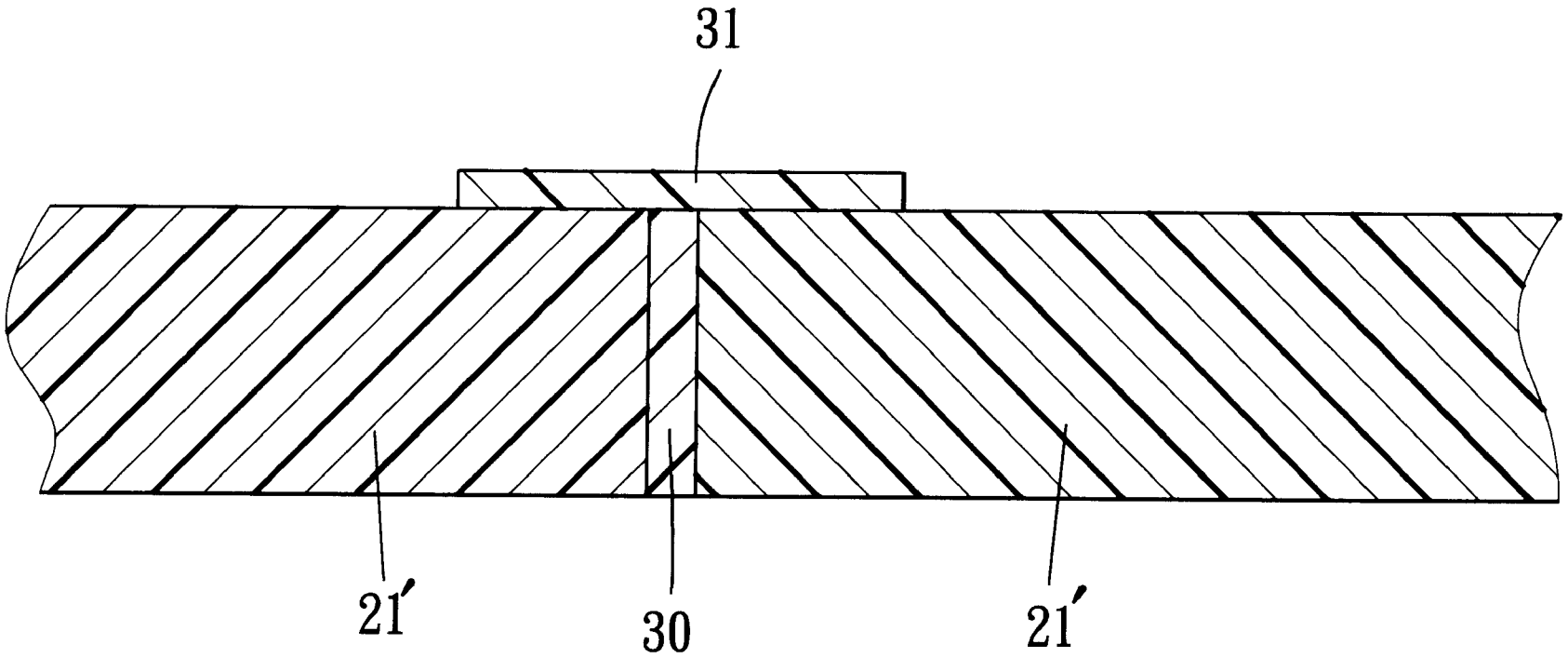

Referring to FIG. 7, a shoe 2 embodying the present invention is shown to include an upper shell 10', a lower shell 20' and a sole 50'. The lower shell 20' in this embodiment consists of a single waterproof strap 21', unlike the lower shell 20 of the previous embodiment. The waterproof strap 21' is formed as a loop which extends along both the toe portion and the heel portion of the lower shell 20' and which has two opposite ends extending toward one another and jointed in a watertight sealing relationship. As shown in FIGS. 8 & 8A, the watertight joint between the two ends of the strap 21' has a sealant 30 filled in a clearance between two ends of the straps 21' and a sealing strip 31 attached adhesively to the two ends of the strap 21' inwardly of the sealant 30.

As mentioned in the aforesaid embodiments, the lower shell 20', 20, respectively, include a single waterproof strap 21', and two waterproof straps 21, 22. However, the invention is not limited thereto. The lower shell according to the present invention may also include more than two waterproof straps, such as, those including a toe piece, a counter piece and sections between the toe and counter pieces.

Figure 9:
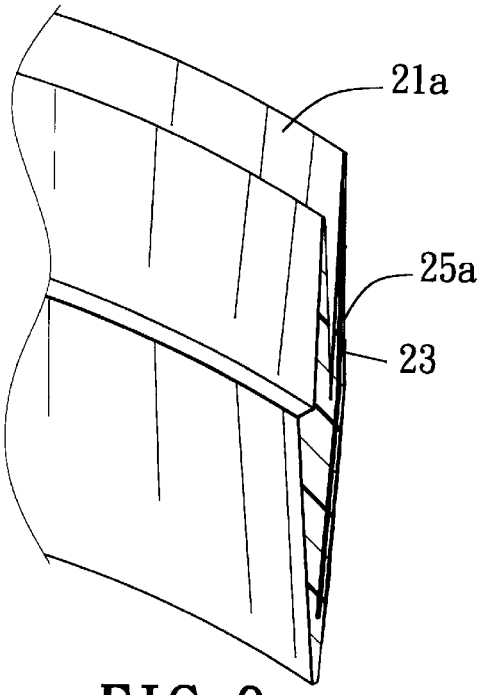
FIG. 9 shows a first example of the reinforced strap according to the present invention.
Figure 10:
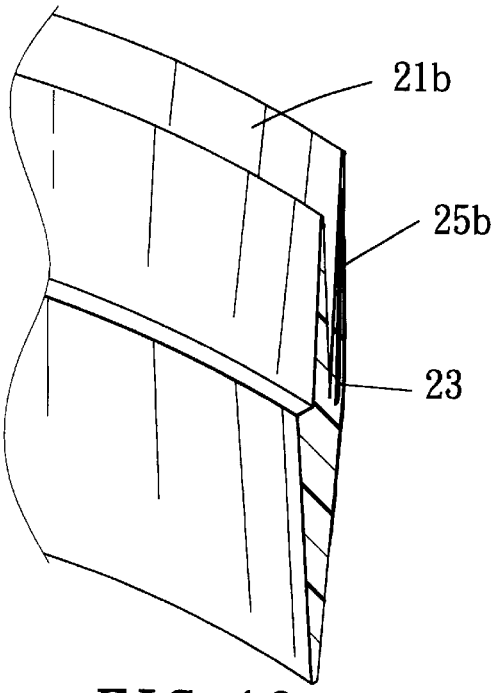
FIG. 10 shows a second example of the reinforced strap of the invention.
Figure 11:
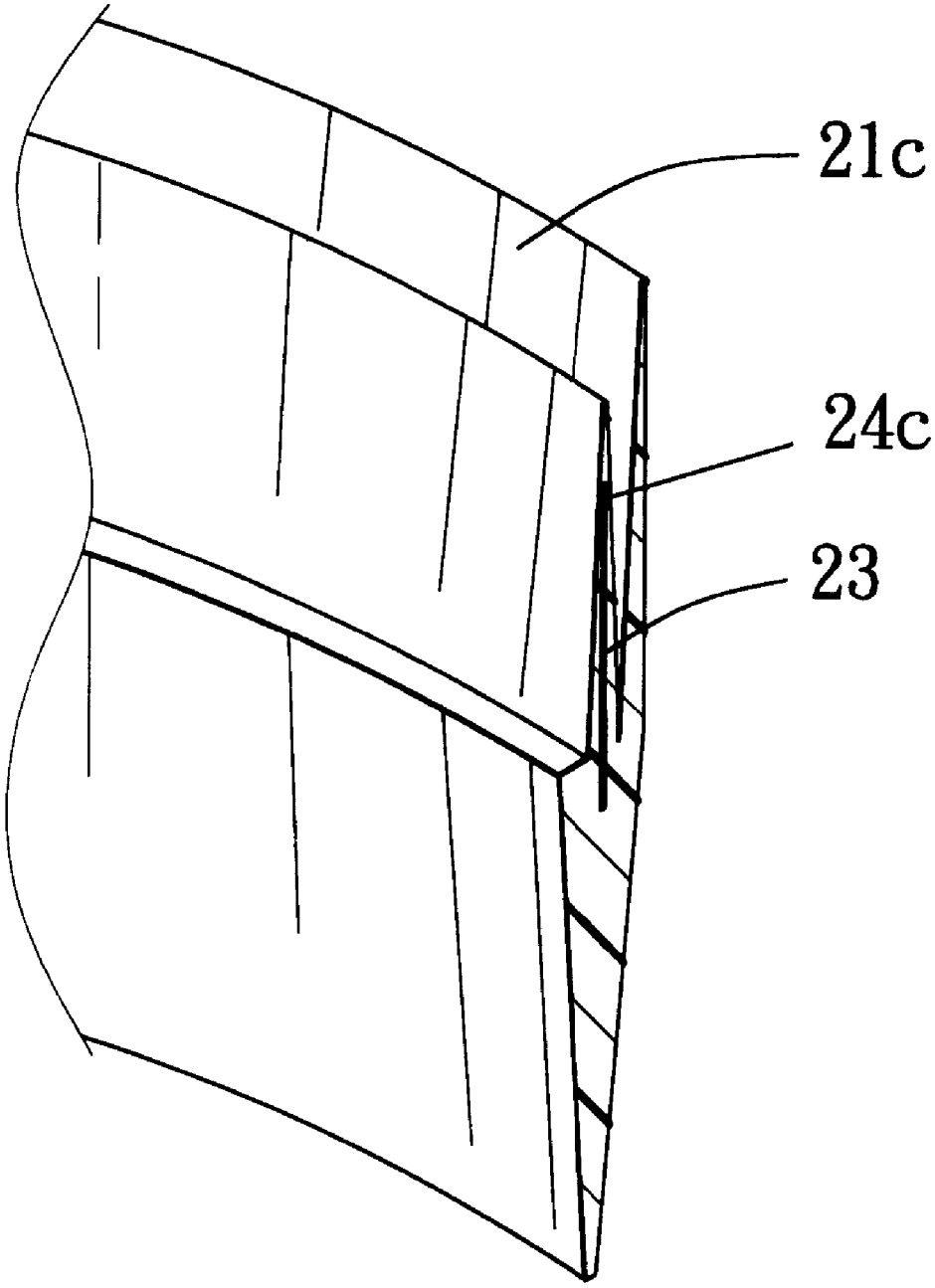
FIG. 11 shows a third example of the reinforced strap of the invention.

The waterproof straps in the present invention may be reinforced by using a fibrous reinforcing material, such as a fabric. Examples of such reinforced waterproof straps are shown in FIGS. 9 to 11. In FIGS. 9 and 10, waterproof straps 21*a,* 21*b,* are reinforced at sealing parts 25*a,* 25*b* thereof with a fabric 23. The fabric 23 is introduced during the process of forming the strap 21*a* or 21*b* from a waterproof material and is bonded to the waterproof material via an impregnation with the waterproof material. In FIG. 11, a waterproof strap 21*c* is reinforced at a water draining part 24*c* with the fabric 23.

As compared to the conventional waterproof foot portion of a shoe, which is formed via a mold cavity, the lower shells 20, 20' according to the present invention can be produced at a reduced cost due to the use of the waterproof straps obtainable from a sheeting material which can be formed without using expensive molds having mold cavities. With the waterproof straps, the lower shell 20, 20' can be formed via a lasting process using inexpensive lasts. In addition, because of the waterproof strap which has the sealing part integral with the water draining part, a watertight sealing process can be conducted conveniently without the need to prepare and attach an extra sealing strip, thus facilitating the sealing process as compared to a conventional process which utilizes a separate sealing strip for sealing a stitched joint.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A shoe comprising:

an upper shell having a top open end and a bottom open end;

a lining sleeve disposed inside and lining said upper shell, said lining sleeve having a top open end connected to said top open end of said upper shell and a bottom open end extending along said bottom open end of said upper shell;

a sole;

a lower shell disposed between said sole and said upper shell, said lower shell consisting of at least one waterproof strap which is made of a waterproof material and which has a bottom margin connected to said sole, and a top margin to connect with said upper shell and said lining sleeve, said top margin being bifurcated to form an upwardly extending water draining part and an upwardly extending sealing part, said sealing part extending inwardly of said water draining part and having a height approximately equal to or greater than that of said water draining part, said water draining part extending inwardly of and being sewn to said bottom open ends of said upper shell and said lining sleeve, thus forming a stitch joint, said sealing part being sealingly bonded to said stitch joint.

2. The shoe as claimed in claim 1, wherein said waterproof strap further includes a watertight adhesive material disposed between and bonding said sealing part to said water draining part at said stitched joint.

3. The shoe as claimed in claim 1, wherein said lower shell defines a toe portion and a heel portion connected to said toe portion and includes a single one of said waterproof strap, said waterproof strap being looped to extend along both said toe and heel portions and having two opposite ends which extend toward one another and are jointed sealingly together.

4. The shoe as claimed in claim 1, wherein said lower shell defines a toe portion and a heel portion connected to said toe portion, and including a pair of said waterproof straps, one of said straps extending along said toe portion, the other one of said straps extending along said heel portion, said straps having ends jointed sealingly together at two opposite sides of said lower shell between said toe and heel portions.

5. The shoe as claimed in claim 1, wherein said waterproof strap further includes a plurality of notches in said bottom margin.

6. The shoe as claimed in claim 5, wherein said bottom margin of said waterproof strap is lasted.

7. The shoe as claimed in claim 1, wherein said top margin of said waterproof strap further includes a shoulder which projects outwardly from said water draining part, said bottom open ends of said upper shell and said lining sleeve resting on said shoulder.

8. The shoe as claimed in claim 7, wherein said shoulder has a width which is substantially equal to the total thickness of said bottom open ends of said upper shell and said lining sleeve.

9. The shoe as claimed in claim 7, wherein said waterproof strap further includes a plurality of water draining grooves formed in the edge of said shoulder.

10. The shoe as claimed in claim 1, wherein said waterproof strap further includes a reinforcing fabric bonded to said waterproof material.

11. The shoe as claimed in claim 10, wherein said reinforcing fabric is disposed in said water draining part.

12. The shoe as claimed in claim 10, wherein said reinforcing fabric is disposed in said sealing part.

* * * * *